US005502843A

United States Patent [19]

Strickland

[11] Patent Number: 5,502,843

[45] Date of Patent: Apr. 2, 1996

[54] HELMUT FACE MASK WITH ADJUSTABLE DISENGAGEMENT MEANS

[76] Inventor: Ronald R. Strickland, 420 Loder Ave., Wilmington, N.C. 28409

[21] Appl. No.: 435,395

[22] Filed: May 5, 1995

[51] Int. Cl.[6] ..... A42B 3/20; A44B 18/00

[52] U.S. Cl. ..... 2/424; 2/425; 2/9; 24/442

[58] Field of Search ..... 2/9, 10, 206, 410, 2/422, 424, 425, 909, 918, 920; 24/16 R, 306, 442

[56] References Cited

U.S. PATENT DOCUMENTS 4,005,506 2/1977 Moore ..... 24/16 R 4,390,995 7/1983 Walck ..... 2/9

4,854,015 8/1989 Shaull ..... 24/16 R

*Primary Examiner*—Michael A. Neas

*Attorney, Agent, or Firm*—Rhodes, Coats & Bennett

[57] ABSTRACT

Athletic headgear is described comprising a helmet having a face mask releasably attached to the helmet with a plurality of adjustable fasteners, each fastener including a mounting plate with a fixed section of hook-and-pile material thereon, a face mask receiving groove, a cooperating section of hook-and-pile material secured at one end to the mounting plate and adapted to extend around the face mask receiving groove and into contact with the fixed section of hook-and-pile material, and an adjustable spacer positionable in a recess in the mounting plate to partly prevent engagement of the hook-and-pile sections.

20 Claims, 3 Drawing Sheets

HELMUT FACE MASK WITH ADJUSTABLE DISENGAGEMENT MEANS

BACKGROUND OF THE INVENTION

The present invention relates to an improved athletic or sports helmet, such as a football or ice hockey helmet, with a releasable or breakaway face mask or face guard. The invention relates in particular to an athletic helmet having an open frontal opening at least partly covered by a face mask, in which the face mask is attached to the helmet by adjustable fasteners, whereby the force required to detach the face mask from the helmet is readily adjustable, allowing the helmet to be worn by different users. The adjustable fasteners are designed in such a manner that they can be mounted on an existing helmet using the mounting hold originally used to secure the face mask to the helmet.

Athletic headgear of the type described herein is comprised of a protective helmet having an attached face mask or guard, normally comprised of a grid-like configuration of bars or rods positioned in front of the wearer's face, with the mask being attached in some manner to the headgear. This mask, while providing protection to the wearer's face, also creates a risk of injury to the user, since an opponent will occasionally, through intent or inadvertence, grab the face mask when attempting to tackle or restrain the wearer. As a result, the entire helmet may be twisted, potentially causing injury to the wearer's neck. Injuries of this nature are highly dangerous and can cause paralysis.

The risk attendant to the use of headgear with face masks is recognized in several prior art patents which attempt to address the problem by providing attachment means which hold the face mask securely to the helmet during normal use, but which will release the face mask from the helmet when the force applied to the face mask exceeds a predetermined amount. Normally, in the constructions disclosed in the prior art patents, the face mask is secured to the headgear with hook-and-pile material, clips, or some type of spring-loaded attachment. The following patents are illustrative of prior art constructions:

| | |
|---|---|
| 2,986,739 Rozzi | 3,283,336 Critser |
| 3,889,296 Martin | 4,233,687 Lancellotti |
| 4,271,537 Bowlus et al | 4,335,472 Rappleyea |
| 4,363,140 Correale | 4,495,657 Bay |
| 4,748,696 Fohl | 4,774,729 Coates et al |
| 4,885,807 Snow | 4,947,490 Hayden |
| 4,985,938 Snow | |

While the above prior art recognizes the need for a releasable face mask, it fails to take into account the fact that the force needed to detach a face mask should be greater in some instances than others. Specifically, more mature players, i.e., adults and larger children, will be less subject to injury and can wear helmets in which release of the face mask from the headgear can be effected only with relatively high force, thus permitting some protection of the player, while still permitting a relatively high degree of physical contact, normally associated with playing of the game by adult players. On the other hand, when the helmet is to be worn by a relatively younger player, there is a need for a construction permitting a relatively easier release of the face mask, since the immature player may be more readily injured.

While headgear described in the prior art could be designed to meet the needs of any given wearer, the prior art has not provided a way for different players to wear the same headgear, with the releasability of the face mask being adjustable to meet the needs of the different players wearing the helmet. A construction of this type would be of great value in that there would be a considerable cost savings and convenience in allowing different players to wear the same helmet, while still having the safety feature of a face mask releasable at a force level addressing the needs of the individual user.

Thus, it is an objective of the present invention to provide an improved fastener for securing a face mask to a helmet in which the fastener can be adjusted to provide for different forces to release the face mask.

It is another object of the present invention to provide athletic headgear comprised of a helmet with a frontal opening, a face mask positionable over the frontal opening, and a plurality of fasteners for releaseably securing the face mask to the helmet, with the fasteners being adjustable to change the force required to release the face mask from the headgear.

Still another object of the present invention is to provide an improved adjustable fastener for securing a face mask to an existing helmet in which the fastener can be mounted in existing mounting holes, thereby retrofitting helmets having non-releasable face masks.

Other objects will be apparent to one skilled in the art upon a reading of the detailed description which follows.

SUMMARY OF THE INVENTION

In general, the present invention is directed to athletic or sports headgear comprised of a helmet, a detachable face mask, and a plurality of adjustable fasteners for releaseably securing the face mask to the headgear. The present invention is also directed to an adjustable fastener that can be adjusted to change the force required to detach the face mask from the headgear.

The helmet of the present invention is of a generally conventional shape and construction, and is comprised of a hard outer shell formed of fiberglass or a molded plastic. This outer shell will have a curved outer surface, extending over the top, sides and back of the wearer's head, as well as the wearer's forehead. The helmet includes a frontal opening, i.e., the area in front of the wearer's face and to each side extending backward to just alongside the wearer's eyes, so that frontal and peripheral vision is unobstructed. A resilient inner liner is positioned between the interior of the outer shell and the wearer's head to provide comfort, and to cushion any blows to the head.

The facial area of the wearer is protected by a face mask or face guard attached to the helmet over at least part of the frontal opening. The exact configuration of the face mask will vary somewhat depending upon the manufacturer's design and especially depending upon the position played by the wearer of the mask e.g., the face mask of a quarterback's helmet will be different from the face mask of a lineman's helmet. Generally, the face mask will be comprised of a plurality of horizontal bars, and often connecting vertical bars, which together form a grid-like configuration extending across the frontal area of the helmet. These bars will be attached to a face mask attachment bar or other mask attachment means which, in ram, will be secured to the helmet. Normally, the attachment bar will be positioned on the helmet adjacent the frontal opening.

In the present invention, a plurality of adjustable fasteners are secured to the outer surface of the helmet to releasably secure the attachment bar of the face mask to the helmet. Generally, the fasteners are comprised of a mounting plate with an upper surface, a curved inner surface corresponding to the curvature of the outer surface of the headgear, so that the plate can be easily secured to the helmet. The mounting plate also includes a mask receiving groove or slot adapted to receive the face mask attachment bar so that it can be held securely against the mounting plate.

The face mask is held onto the mounting plate with a hook-and-pile material. A commercial example of hook-and-pile material is sold under the trademark Velcro. Hook-and-pile material is well known in the art and is comprised of a pile section and a hook section. When these sections are pressed together, the hooks on the hook section engage the nap or loops of the pile section and hold securely until the sections are forcibly detached. The degree of force required to effect this detachment depends upon the construction of the hook-and-pile product and the surface area over which the two sections are in engagement.

In the present invention, one section of the hook-and-pile material, e.g., the hook section, is secured, e.g., by an adhesive, to the upper surface of the mounting plate while the other section of the hook-and-pile material, e.g., the pile section is in the form of a strap having one end attached to the mounting plate, with the remainder of the section extending over the face mask bar attachment groove and into engagement with the hook section of the hook-and-pile material. The sections can be reversed, with the pile section being secured to the upper surface of the mounting plate. Thus, the face mask attachment bar, when inserted into the receiving groove, can be securely held in engagement with the mounting plate, so long as the two sections of the hook-and-pile material are in engagement.

In order to be able to change the force required to separate the two sections of the hook and pile material, and thus release the face mask from the headgear, an adjustable spacer is positioned between the two hook-and-pile sections. As will be shown in detail in the description of the preferred embodiment, the spacer is preferably positioned within a recess in the upper face of the mounting plate.

The recess in the mounting plate is comprised of a lower section and an upper section extending to the upper surface of the mounting plate. The upper section of the recess has a dimension greater than a corresponding dimension of said lower section. The spacer insertable within the recess is also comprised of lower and upper sections, that correspond in size and shape to the lower and upper sections of said recess, i.e., the upper section of the spacer has a dimension larger than the corresponding dimension of the lower section. The sections may, for instance, be rectangular solids or hexahedrons with the width and/or length of the larger or upper section being greater than the corresponding dimension of the smaller or lower section. As shown in the preferred embodiment, the spacer and recess are both of a T-shaped cross-section.

When the spacer is in an upright attitude, it can be inserted fully within the slot so that the top of the spacer is in a plane with the upper surface of the mounting plate, thus permitting full engagement of the two sections of the hook-and-pile material, providing maximum attachment. In this configuration, a relatively large force is required to separate the face mask from the headgear.

When the spacer is inserted into the recess when in an inverted attitude, however, the larger section of the spacer is inserted into the larger section of the recess, while the smaller section of the spacer projects upward from the upper surface of the mounting plate. A portion of the cooperating section is held away from the fixed section by the presence of the spacer, preventing full engagement of the hook-and-pile sections. Since a smaller area of the hook-and-pile sections are in engagement, a relatively smaller force is required to separate the two surfaces, and thus the face mask from the headgear.

Preferably, the mounting plate also includes a pair of spaced side walls to aid in alignment of the hook-and-pile materials, and also prevent inadvertent release of the hook-and-pile materials due to shearing forces which might be incurred during normal use, e.g., during contact of the mounting plate with the ground surface.

It will be obvious to one skilled in the art that the force required to disengage the face mask from the head gear with a given helmet construction and a given type of hook and pile material, will depend upon the surface area over which the two sections of the hook and pile material engage. It will also be apparent to one skilled in the art after reading the present disclosure, that the presence of the spacer will decrease the amount of this surface area, and that height of the spacer above the top surface of the mounting plate will determine the degree of separation of the two sections, i.e., the percentage reduction of the contact area.

DETAILED DESCRIPTION OF THE PREFERRED EMBODIMENT

In the following description, terms such as horizontal, upright, vertical, above, below, beneath, and the like, are used solely for the purpose of clarity in illustrating the invention, and should not be taken as words of limitation.

Figure 1:
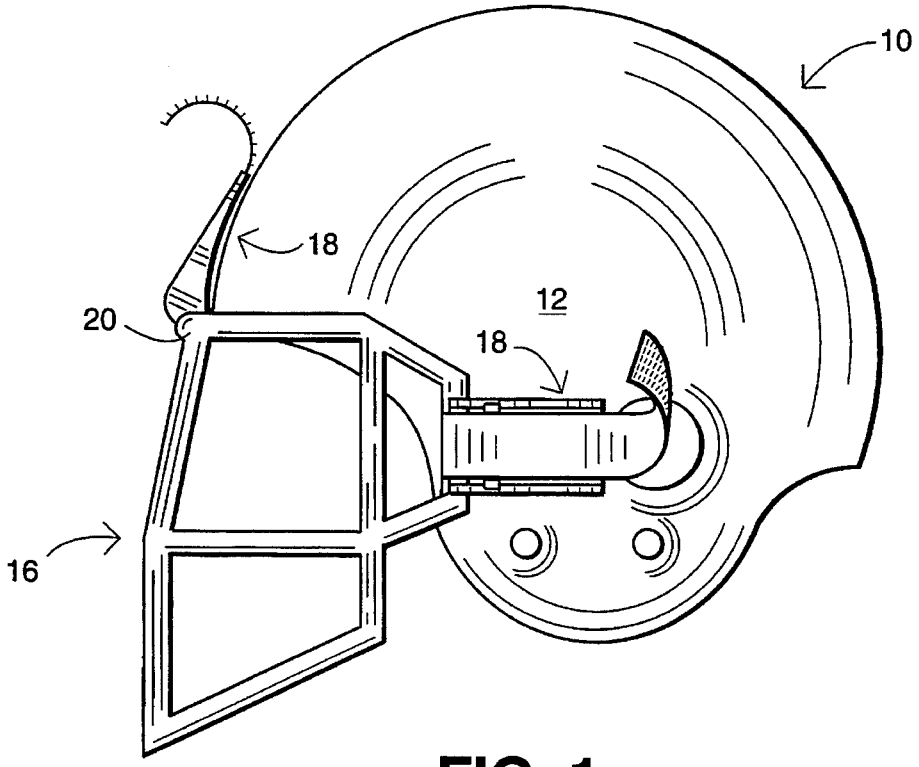
FIG. 1 is a side view of the helmet of the present invention showing a face mask secured to a headgear section with a plurality of fasteners.
Figure 2:
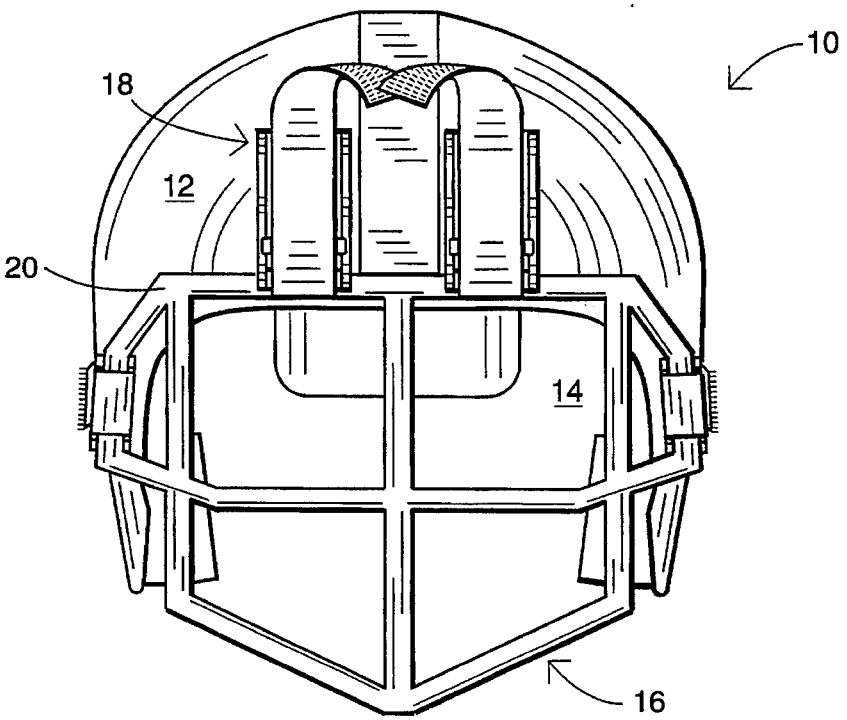
FIG. 2 is a frontal view of the helmet shown in FIG. 1.
Figure 3:
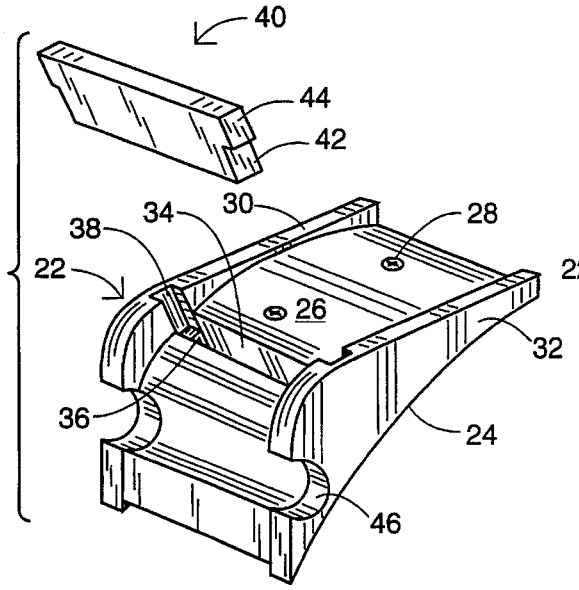
FIG. 3 is an exploded view of a fastener with the spacer turned for full insertion into the recess in the lowered configuration.
Figure 4:
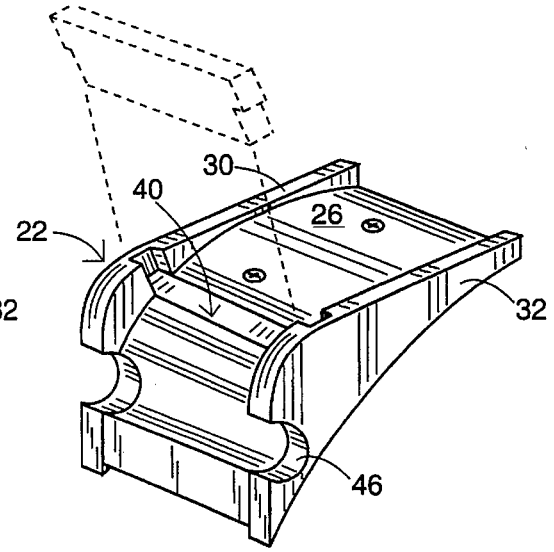
FIG. 4 is a perspective view of the fastener of FIG. 3 with the spacer fully inserted into the recess.
Figure 5:
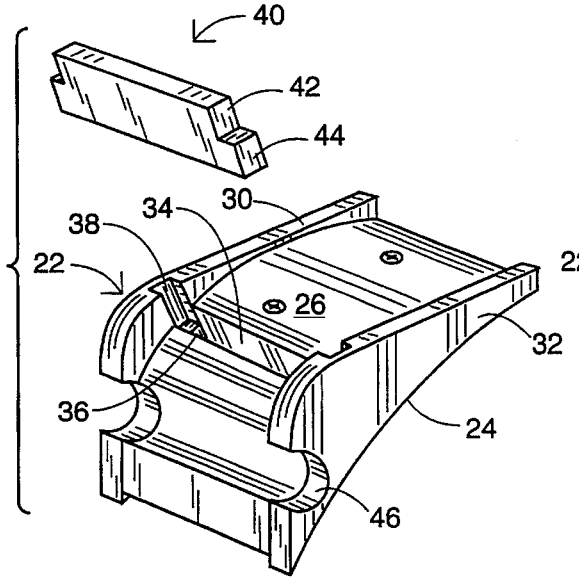
FIG. 5 is a exploded, perspective view of a fastener without the hook-and-pile section with the spacer in the inverted configuration.
Figure 6:
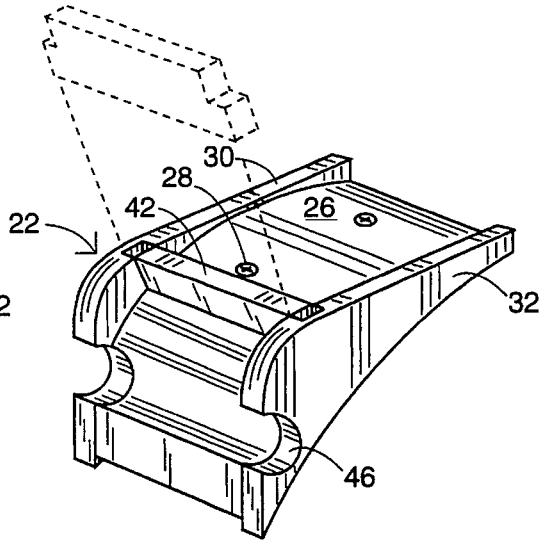
FIG. 6 is a perspective view of the fastener of FIG. 5 with the spacer positioned in the raised or inverted position in the recess.

As best shown in FIGS. 1 and 2, the preferred athletic headgear is comprised of a helmet, generally 10, formed of a hard outer shell 12 and a resilient inner liner 14. A face mask, generally 16, is secured to across the frontal opening of the helmet with a plurality of adjustable fasteners, generally 18, which secure attachment bar 20 of mask 16 to helmet 10.

As best shown in FIGS. 3–8*a*, each fastener 18 is comprised of a mounting plate 22 having a curved lower surface 24 shaped to conform to the outer surface of helmet 10, and an opposed upper surface 26. Mounting screws 28, which can be inserted through existing holes when retrofitting a helmet, secure mounting plate 22 to helmet 10. A pair of spaced upright sidewalls, 30 and 32, are positioned along the outer edges of upper surface 26. Upper surface 26 includes a spacer recess, generally 34, comprised of a lower section 36 of a given width and an upper section 38 having a width greater than the given width of the lower section.

Fastener 18 also includes reversible spacers, generally 40, shaped for insertion into recess 34. Spacer 40 is comprised of a lower section 42 having a shape corresponding to the shape of lower section 36 of recess 34, and an upper section 44 having a shape corresponding to the shape of upper section 38 of recess 34. In the upright position, spacer 40 is adapted to be fully inserted into recess 34 so that the top of spacer 40 is aligned with upper surface 26. When spacer 40 is inverted, however, upper section 44 fits within the upper section 38 of recess 34, while the lower section 42 of spacer 40 projects upward from surface 24.

Mounting plate 22 also includes a face mask bar receiving groove 46 along its lower end for receiving attachment bar 20 of face mask 16. The size and shape of groove 46 corresponds to the size and shape of bar 20 to ensure a snug fit. For example, groove 46 will have a semi-circular cross-section when receiving a circular face mask bar.

A fixed section of hook-and-pile material 48, which may be the hook section or the pile section, is secured to upper surface 26 of mounting plate 22 with a lower part of the section being between spacer recess 34 and bar receiving groove 46 and another part being on the opposite said of recess 34. The cooperating section of hook-and-pile material 50 is attached at one end to the lower surface of mounting plate 22, and is adapted to be firmly wrapped around face mask bar 20 and onto upper surface 26 of mounting plate 22.

Generally, fixed section 48 will be the hook section of the hook-and-pile material, while cooperating section 50 will be the pile section. However, it should be understood that these sections can be reversed.

Figure 7:
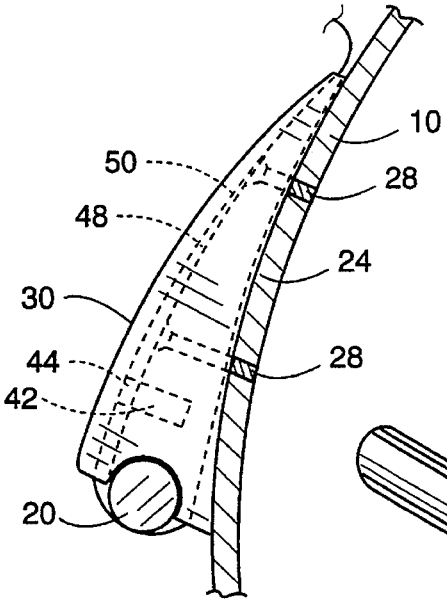
FIG. 7 is a side view of a fastener showing the face mask mounting bar secured to the fastener with hook-and-pile material and the spacer in the lowered position.
Figure 7A:
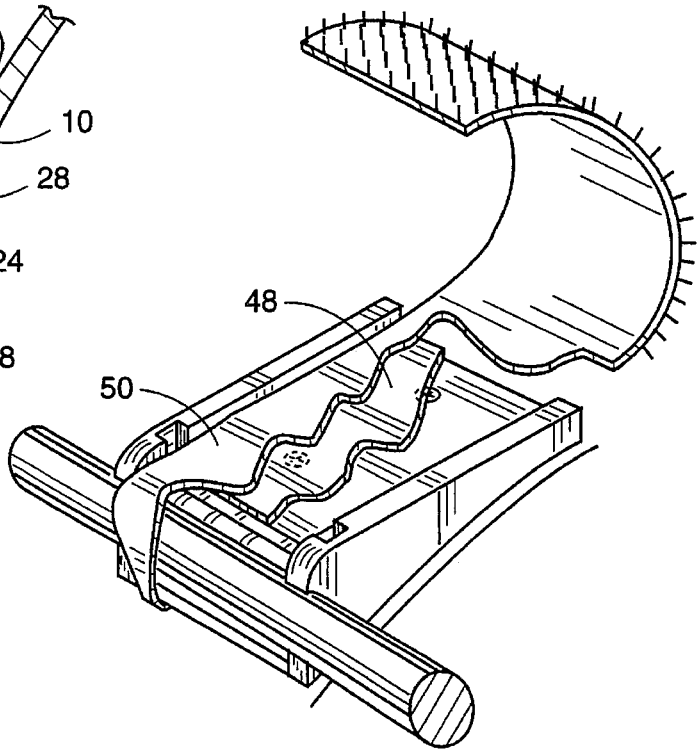
FIG. 7*a* is a perspective view of the fastener shown in FIG. 7.
Figure 8:
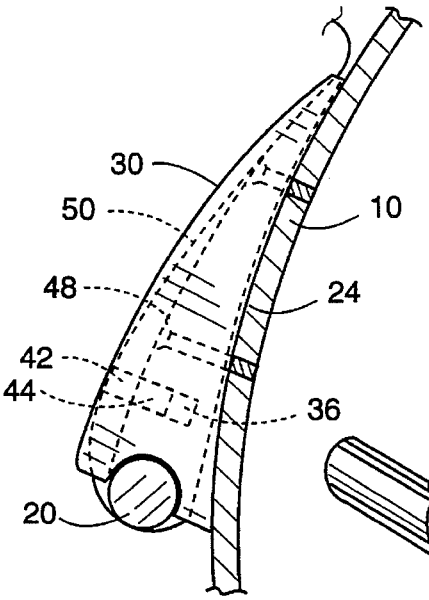
FIG. 8 is a side view of a fastener showing the face mask mounting bar secured to the fastener with hook-and-pile material and the spacer in the raised position.
Figure 8A:
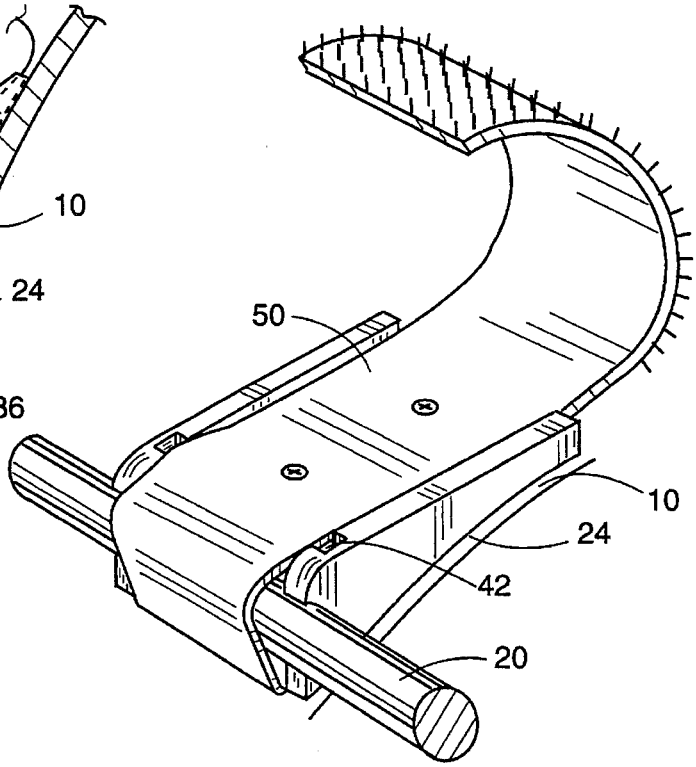
FIG. 8*a* is a perspective view of the fastener shown in FIG. 8.

As seen in particular in FIGS. 7–8*a*, hook and pile sections 48 and 50, fully engage each other over the entire surface area of section 48 when spacer 40 is in the fully inserted position. When spacer 40 is in the inverted or raised position as shown in FIG. 8, however, book and pile section 50 only engages section 48 at the upper end of mounting plate 22, since spacer 40 prevents engagement of sections 48 and 50 adjacent recess 34. Therefore, the area of engagement, and thus the force needed for separation, is reduced.

Accordingly, when helmet 10 is to be worn by an adult or larger child who is physically able to endure greater forces without the likelihood of injury, spacer 40 is inserted into recess 34 in the upright position, so that spacer 40 is fully inserted and does not project above surface 24. Face mask attachment bar 20 is then seated into groove 46 and hook-and-pile section 50 is firmly wrapped around bar 20 and into engagement with all of the surface of section 48 to provide maximum attachment.

On the other hand, when the helmet is to be worn by a younger child, or a person who might be injured if subjected to the physical forces endurable by the adult or larger child, spacer 40 is inverted before insertion into recess 34, so that the smaller section 42 of spacer 40 projects upwardly above surface 26 of the mounting plate 22. As a result, only part of section 48 is engaged by section 50, requiting a relatively smaller force to separate the two sections, thus reducing injury to the younger player.

Certain modifications and improvements will occur to those skilled in the art on a reading of the foregoing description. By way of example, section 50 of the hook-and-pile material may be attached differently to the mounting plate 22 so long as an end of the moveable section is attached on one side of the bar receiving groove 46 and fixed section 48 of the hook-and-pile material is attached to the opposite side of groove 46. Also, spacers having smaller sections of different lengths can be placed within the spacer recess to change the surface area engaged by the hook and pile sections. It should be understood that all such modifications and improvements have been deleted herein for the sake of conciseness and readability and are properly within the scope of the following claims.

What is claimed is:

1. An adjustable fastener for releasable attaching a face mask to an athletic helmet comprising:

a) a mounting plate having a lower surface, an upper surface and a face mask receiving area;

b) a fixed section of hook-and-pile material secured to said mounting plate upper surface;

c) a cooperating section of hook-and-pile material having one end secured to said mounting plate, said cooperation section being adapted to extend from said secured end around said face mask receiving area and into contact with said fixed section of hook-and-pile material; and d) an adjustable spacer positioned on said mounting plate, said spacer having a raised position and a lowered position.

2. The fastener of claim 1, wherein the lower surface of said mounting plate is shaped to conform to the shape of said helmet.

3. The fastener of claim 1, wherein said face mask receiving area is a groove at one end of said mounting plate.

4. The fastener of claim 1, further including attachment means to secure said mounting plate to said helmet.

5. The fastener of claim 1, wherein said mounting plate further includes upwardly extending side walls on either side of said upper surface.

6. The fastener of claim 1, wherein said cooperating section is secured at one end to the lower surface of said mounting plate.

7. The fastener of claim 1, wherein said mounting plate includes a spacer receiving recess in said upper surface, and said spacer is positioned in said recess.

8. The fastener of claim 7, wherein said recess includes a lower section and an upper section, said upper section having a dimension greater than a corresponding dimension of said lower section, and said spacer includes lower and upper sections corresponding in size and shape to the lower and upper sections of said recess.

9. The fastener of claim 7, wherein said fixed section of hook-and-pile material is comprised of two parts, with said recess being between said parts.

10. The fastener of claim 9, wherein one of said hook-and-pile material parts is secured to said mounting plate between said recess and said face mask receiving area.

11. Athletic headgear comprising:

a) a helmet having a curved surface and an open frontal area;

b) a face mask extending over at least a part of said helmet frontal area; and c) an adjustable fastener including a mounting plate with a lower surface attached to said helmet, an upper surface having a fixed section of hook-and-pile material thereon, a face mask receiving area between said upper and lower surfaces, a cooperating section of hook-and-pile material secured at one end to said mounting plate and adapted to extend around said face mask receiving area and into contact with said fixed section of hook-and-pile material, and a spacer positioned on said mounting plate, said spacer insertable between said hook-and-pile sections to prevent engagement on a portion of said sections.

12. The headgear of claim 11, wherein said mounting plate is positioned on said helmet with a lower end adjacent said helmet frontal area and said face mask receiving area comprises a groove in said lower end.

13. The fastener of claim 11, wherein said mounting plate further includes upwardly extending side walls on either side of said upper surface.

14. The fastener of claim 11, wherein said cooperating section is secured at one end to the lower surface of said mounting plate.

15. The fastener of claim 11, wherein said mounting plate includes a spacer receiving recess in said upper surface, and said spacer is positioned in said recess.

16. The fastener of claim 15, wherein said recess includes a lower section and an upper section, said upper section having a dimension greater than a corresponding dimension of said lower section, and said spacer includes lower and upper sections corresponding in size to the lower and upper sections of said recess.

17. The fastener of claim 16, wherein said fixed section of hook-and-pile material is comprised of two parts, with said recess being between said parts.

18. The fastener of claim 17, wherein one of said hook-and-pile material parts is secured to said mounting plate between said recess and said face mask receiving area.

19. An adjustable fastener for releasable attaching a face mask to an athletic helmet having a frontal opening and a curved outer surface comprising:

a) a mounting plate having a lower surface shaped to conform to the shape of said helmet outer surface, an upper surface, upwardly extending side walls on either side of said upper surface, a face mask receiving groove positionable adjacent said frontal area of said helmet, and a spacer recess in said upper surface, said recess including lower and upper sections, said upper section having a dimension greater than a corresponding dimension of said lower section;

b) attachment means for attaching said plate to said helmet outer surface;

c) a fixed section of hook-and-pile material secured to said mounting plate upper surface, said fixed section of hook-and-pile material being comprised of two parts, with said recess being between said parts, and one of said parts being between said recess and said face mask receiving area;

d) a cooperating section of hook-and-pile material having one end secured to the lower end of said mounting plate, said cooperating section being adapted to extend from said secured end around said face mask receiving area and into contact with said fixed section of hook-and-pile material; and e) an adjustable spacer positioned in said recess, said spacer having a raised position and a lowered position, said spacer includes lower and upper sections corresponding in size and shape to the lower and upper sections of said recess.

20. Athletic headgear comprising:

a) a helmet having a curved surface and an open frontal area;

b) a face mask extending over at least a part of said helmet frontal area, said face mask including an attachment bar; and c) a plurality of fasteners attached to said helmet, each fastener including a mounting plate with a lower surface, an upper surface having a fixed section of hook-and-pile material thereon, upwardly extending side walls, a face mask attachment bar receiving groove adjacent said frontal area between said upper and lower surfaces, a spacer recess, a cooperating section of hook-and-pile material secured at one end to said mounting plate and adapted to extend around said face mask attachment bar receiving groove and into contact with said fixed section of hook-and-pile material, and a spacer positionable in said recess to prevent engagement of parts of said hook-and-pile sections.

* * * * *